US006389710B1

(12) United States Patent
Chou

(10) Patent No.: US 6,389,710 B1
(45) Date of Patent: May 21, 2002

(54) STRUCTURE OF AN INFRARED HAIR DRIER

(75) Inventor: Hsiu-Fang Chou, Taipei (TW)

(73) Assignee: Yin Yen Co., Ltd. (TW)

( * ) Notice: Subject to any disclaimer, the term of this patent is extended or adjusted under 35 U.S.C. 154(b) by 0 days.

(21) Appl. No.: 09/277,948

(22) Filed: Mar. 29, 1999

(30) Foreign Application Priority Data

Sep. 24, 1998 (TW) ..... 87215876

(51) Int. Cl.[7] ..... G03B 13/08
(52) U.S. Cl. ..... 34/97; 392/385; 219/222
(58) Field of Search ..... 34/266, 267, 268, 34/269, 96, 97; 392/380, 383, 384, 385; 219/222

(56) References Cited

U.S. PATENT DOCUMENTS 4,382,174 A * 5/1983 Barns ..... 219/370
4,910,382 A * 3/1990 Kakuya et al. ..... 219/222

* cited by examiner

*Primary Examiner*—Pamela A. Wilson
(74) *Attorney, Agent, or Firm*—A & J

(57) ABSTRACT

An infrared hair drier having a front barrel and a rear barrel mounted with a grille defining the main body of the hair drier, wherein the main body is a conic shape enclosing a tapered inner barrel having a smooth surface for directing air, a first fixing frame having a tapered shape being formed by two vertical boards mounted across from each other and then being mounted within the inner barrel, the larger end of the fixing frame is provided with a recess for the adaption of a conductive metal rim, a second fixing frame, together with the first fixing frame, is used to enclose a heat emitting element, a motor for a fan is mounted to the external edge of the second fixing seat to provide air from an air-inlet when the motor is turned on, and the rear barrel is connected to the front barrel to form the hair drier.

4 Claims, 4 Drawing Sheets

STRUCTURE OF AN INFRARED HAIR DRIER

BACKGROUND OF THE INVENTION (a) Field of the Invention

The present invention relates to a hair drier and in particular, to an improved structure of an infrared hair drier having a ceramic heat emitting element enclosed by a pair of fixing frame.

(b) Description of the Prior Art

Conventional hair driers have substantially similar design as that shown in FIG. 4, which comprises a body 30, an air-outlet 31 at one end of the body 30, an air-inlet 33 provided at the other end of the body 30, and being mounted with a filter cap 32, and a motor 34 having a fan 35 to provide an air stream. The stream of air is released via the air outlet 31. A heat emitting device 36 formed from a resistance coil is provided adjacent to the air-outlet 31. The heat emission device 36 is operated by a control switch 38 mounted on a handle 37 located below the body 30. The speed of the air steam and the selection of cold/hot air stream is selected by pressing the control switch 38.

The drawback of the conventional hair drier is that it is a high heat energy consuming product, and no temperature control is available to control the temperature of the emitted heat. In other words, the simple heat emission coil does not provide a constant temperature. The temperature is varied in accordance with the speed of the fan. At a lower speed, the temperature of air is usually too hot.

Another disadvantage is that the shape and material of the air outlet 3 are often deformed as a result of excessive heat from the hot air.

In view of the above, the conventional hair drier is not safe after a period of use.

SUMMARY OF THE PRESENT INVENTION

Accordingly, it is an object of the present invention to provide an improved structure of an infrared hair drier having a front barrel and a rear barrel mounted with a grille defining the main body of the hair drier, characterized in that the main body is substantially a conic shape enclosing a tapered inner barrel of a smooth surface for air-directing, a first fixing frame having a tapered shape being formed by two vertical boards mounted across each other and is mounted within the inner barrel, the larger end of the fixing frame is provided with a recess for the adaption of a conductive metal rim, a second fixing frame, together with the first fixing frame, is used to enclose a heat emitting element, a motor for a fan is mounted to the external edge of the second fixing frame to provide air from an air-inlet when the motor is turned on, and the rear barrel is connected to the front barrel and forms the hair drier.

Another object of the present invention is to provide an improved structure of an infrared hair drier, wherein the heat emitting element is designed into a beehive shape which provides rapid heat transfer, and the heat emitted from the ceramic material provides a temperature which is controllable and thus the hair drier is a safety electrical appliance.

It is another object of the present invention is to provide an improved structure of an infrared hair drier, wherein the temperature of the emitted heat is consistent and can be easily controlled, and the cost of manufacturing is lower but the safety of the hair drier is upgraded.

It is yet another object of the present invention to provide an improved structure of an infrared hair drier, wherein the application of the ceramic material as the heat emitting element allows convenient mounting and the hot air thus produced is comfortably used to dry hairs.

BRIEF DESCRIPTION OF THE DRAWINGS

The present invention will be more particularly described with reference to the accompanying drawings, in which.

DETAILED DESCRIPTION OF THE INVENTION

Figure 1:
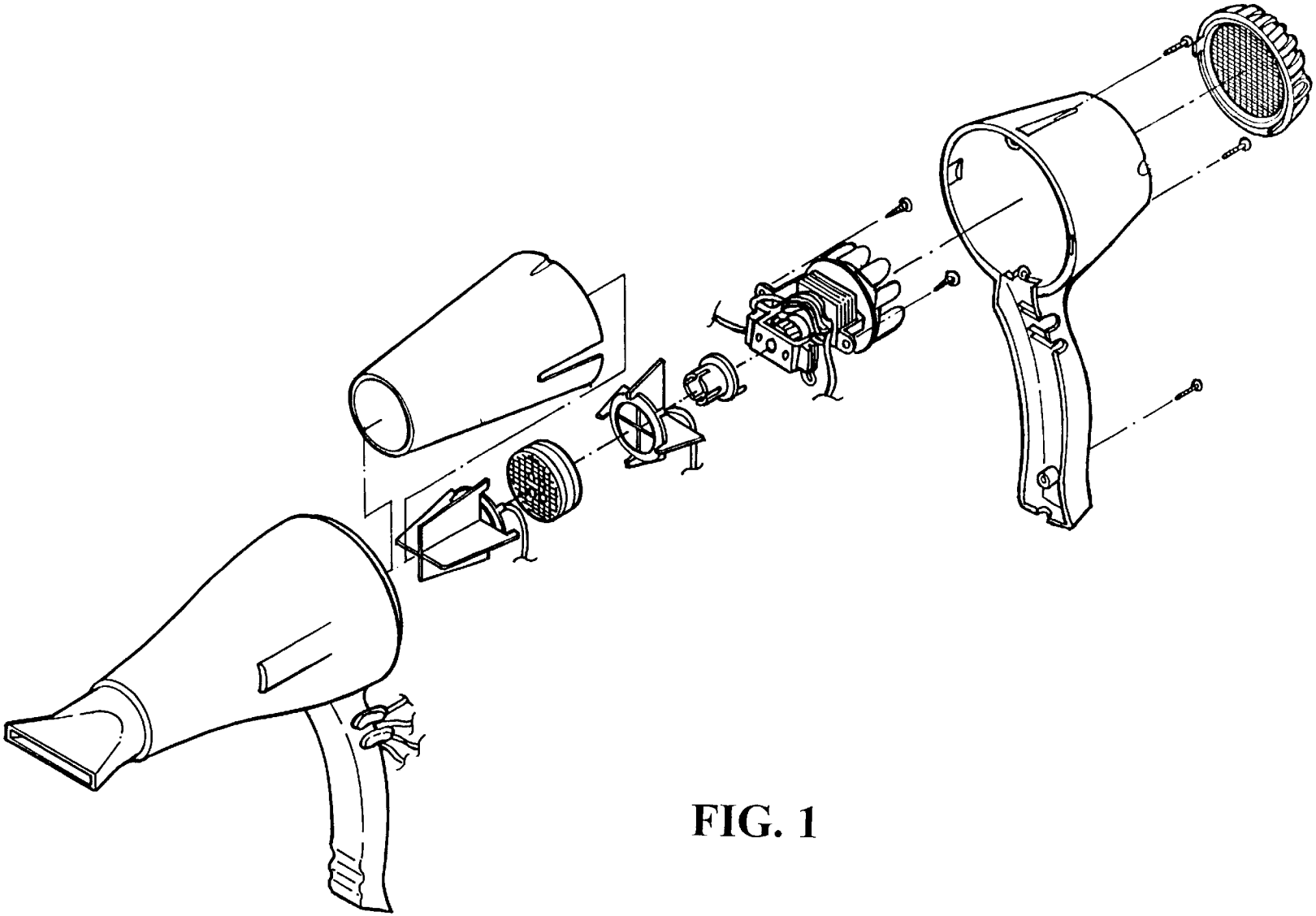
FIG. 1 is an exploded perspective view of the structure of hair drier of the present invention.
Figure 2:
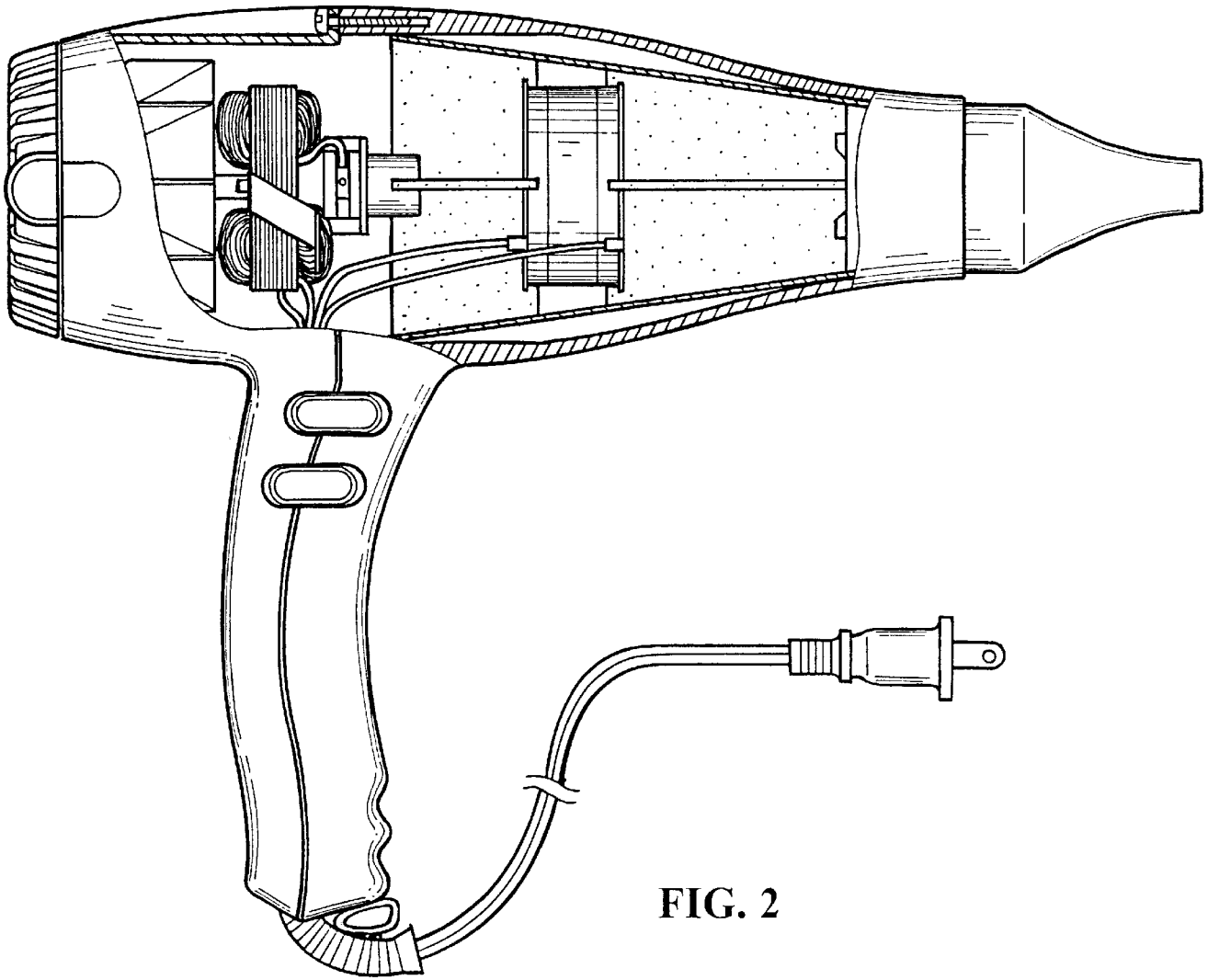
FIG. 2 is a sectional view of the hair drier of the present invention.
Figure 3:
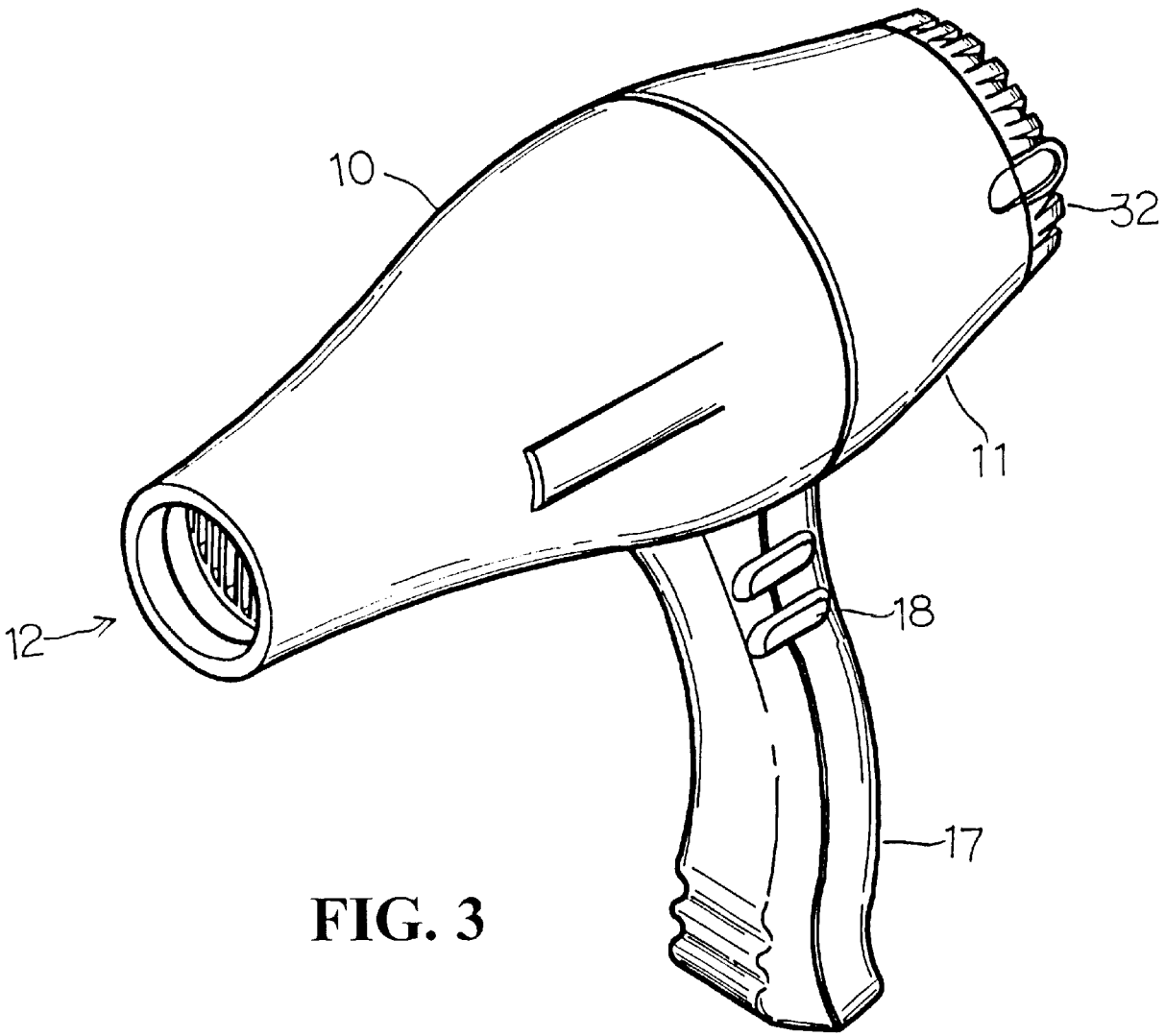
FIG. 3 is a perspective view of the hair drier of the present invention.
Figure 4:
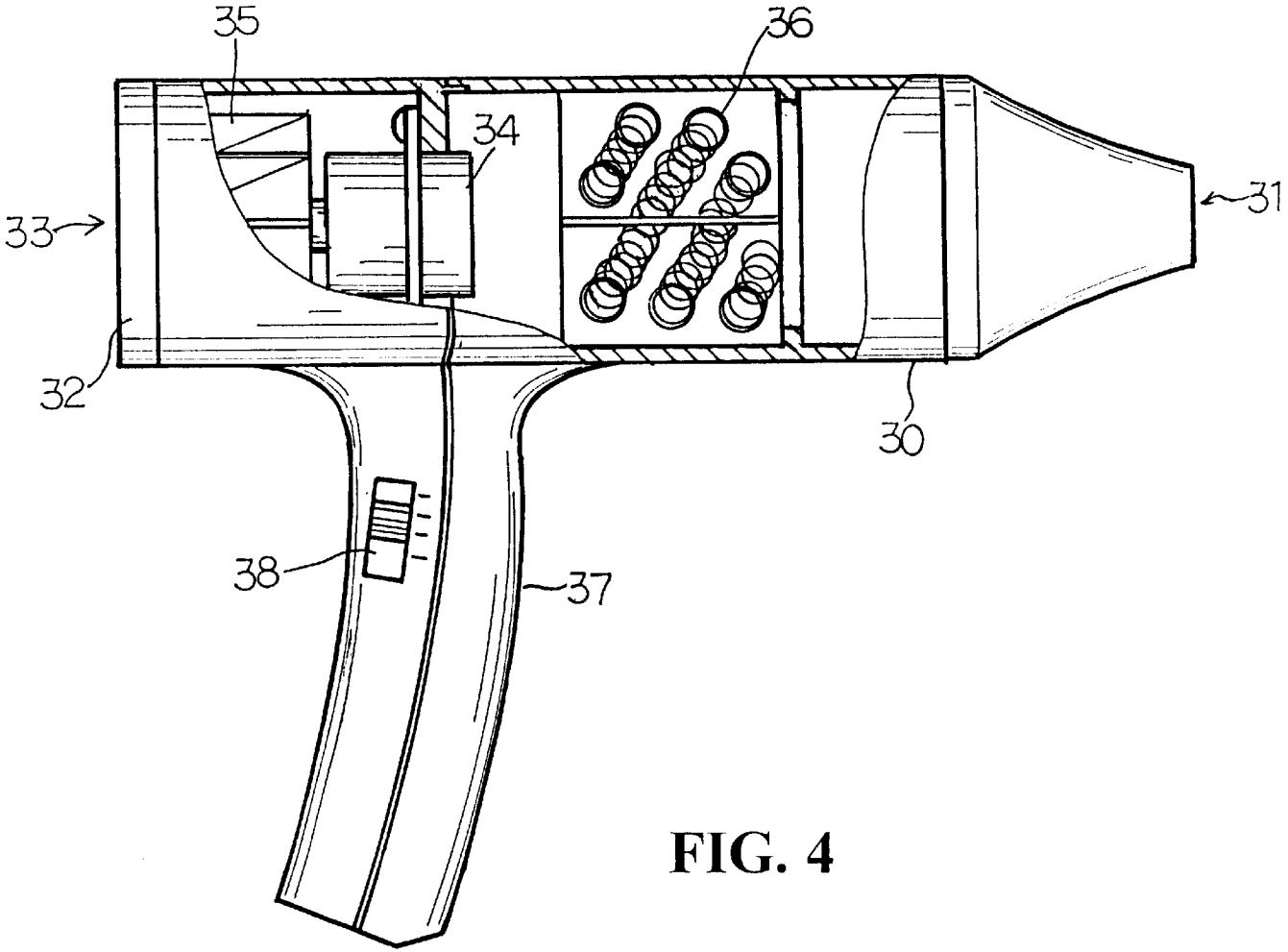
FIG. 4 is a sectional view of a conventional hair drier.

Referring now to the drawings, and in particular, FIGS. 1 to 3, which depict the structure of an infrared hair drier comprises a hollow front barrel 10, a rear barrel 11, an inner barrel 25, and a heat emitting element 22. The front barrel 10 and the rear barrel 11 can be mounted together and with a handle 17 mounted at the bottom face thereof defining an L-shaped main body of the hair drier. The extreme end of the front barrel 10 is a tapered air-outlet 12 mounted with an air-guiding flat tube 13 to direct the air stream produced by the hair drier. The hollow inner barrel 25 has a tapered shape substantially similar to the front barrel 10 so that is can be inserted within the front barrel 10 and to direct air stream to the air-outlet 12. A first fixing frame 20 formed by the mounting of two vertical boards mounted perpendicularly and across each other is mounted within the inner barrel 25. The first fixing frame 20 has a tapered shape, wherein the larger end of the frame 20 is provided with a recess 201 for the adaptation of a metal rim 202 being connected to electrical wires (not shown) so that the metal rim 202 is used as a current conductive rim 202.

In accordance with the present invention and referring to FIG. 1, the heat emitting element 22 is mounted onto the metal rim 202 and is in contact with the metal rim 202. The heat emitting element 22 is made from a ceramic material (which is a product from Taiwan Patent No. 69696). The two ends of the heat emitting element 22 are coated with conductive silicon rubber to form a heat conduction. When the ceramic material is heated and the temperature thereof is elevated to a pre-set temperature, a great amount of infrared radiation will be released. By means of the emission of the infrared radiation and the characteristics of constant high temperature of the heat emitting element 22, the drying effect of the hair drier does not produce uncomfortable dried hot air to the user. In addition, at the external edge of the heat emitting element 22, a second fixing frame 21 is mounted. The shape and structure of the second fixing frame 21 are substantially similar to that of the first fixing frame 22. Similarly, a recess 211 is formed at the larger end of the second fixing frame 22 to mount a conductive metal rim 212 and to enclose the heat emitting element 22.

By means of the two metal rims 202, 212 connected to an electrical source (not shown), a positive and a negative terminal are formed. At the smaller end of the second fixing frame 21, a shaft seat 23 is formed to mount a fan motor 24 having a flange 241. In accordance with the present invention, the motor 24 is mounted at the axis of the main body of the hair drier. The motor 24 is secured by a plurality of screws 16 within the barrels 10, 11. The front barrel 10 and the rear barrel 11 are mounted together by means of a plurality of screws 16 via their respective screw holes 15 provided on the rear barrel 11. The extreme end of the rear barrel 10 is mounted with a grille 14.

In accordance with the present invention, the wiring setup, and the hot/cool air adjustment are connected to a on-off switch 18 at the handle 17. The on-off switch 18 is used to control the selection for hot/cool air, and the required speed of the air stream provided by the hair drier.

FIG. 3 illustrates a sectional view of the hair drier in accordance with the present invention. As shown in the figure, the heat-emitting element 22 is secured by the first fixing frame 20 and the second fixing frame 21 mounted within the inner barrel 25. The inner barrel 25 lowers the temperature of the front barrel 10 such that a great safety is attained by the hair drier of the present invention.

In accordance with the present invention, the heat emitting element 22 is coated with a special coated heat membrane which provides a constant heat emission characteristics, and therefore a lower voltage can be applied to the heat emitting element 22. As a result, when the speed (rpm) of the motor 24 has achieved at several thousands, the noise thus produced can be lowered to a minimum.

In accordance with the present invention, the heat emitting element 22 is designed into a beehive-shaped structure and the volume of the element 22 can be reduced to a practical size.

The on-off switch 17 provides a multi-stage control such that constant temperature at varies speeds can be selected. In other words, the hair drier can comfortably provides air to the user.

While the invention has been particularly shown and described with reference to the preferred embodiment thereof, it will be understood by those skilled in the art that various changes in form and details may be made without departing from the spirit and scope of the invention.

I claim:

1. An improved structure of an infrared hair drier having a front barrel and a rear barrel mounted with a grille defining the main body of the hair drier, characterized in that the main body is substantially a conic shape enclosing a tapered inner barrel having a smooth surface for air-directing, a first fixing frame having a tapered shape being formed by two vertical boards mounted across each other and is mounted within the inner barrel, the larger end of the fixing frame is provided with a recess for the adaption of a conductive metal rim, a second fixing frame, together with the first fixing frame, is used to enclose a heat emitting element, a motor for a fan is mounted to the external edge of the second fixing seat to provide air from an air-inlet when the motor is turned on, and the rear barrel is connected to the front barrel to form the hair drier.

2. An improved structure of an infrared hair drier as set forth in claim 1, wherein one end of the second fixing frame is a recess for the adaptation of the flange of the motor.

3. An improved structure of an infrared hair as set forth in claim 1, wherein the rear barrel is formed into a L-shaped structure with a handle mounted at the lower surface thereof.

4. An improved structure of an infrared hair drier as set forth in claim 1, wherein the extreme end of the front barrel is provided with an air-guiding tube.

* * * * *